US006341763B1

(12) United States Patent
Lefebvre

(10) Patent No.: US 6,341,763 B1
(45) Date of Patent: Jan. 29, 2002

(54) LEVER-ACTION VEHICLE LIFT

(76) Inventor: Normand Lefebvre, 212, Newton, Repentigny, Quebec (CA), J5Y 3G9

( * ) Notice: Subject to any disclaimer, the term of this patent is extended or adjusted under 35 U.S.C. 154(b) by 0 days.

(21) Appl. No.: 09/358,541

(22) Filed: Jul. 22, 1999

(51) Int. Cl.[7] ..... B66F 3/00
(52) U.S. Cl. ..... 254/131
(58) Field of Search ..... 254/94, 131–120; 211/22

(56) References Cited

U.S. PATENT DOCUMENTS

| | | | | |
|---|---|---|---|---|
| 4,180,253 A | * | 12/1979 | Ivers et al. | 254/131 |
| 4,348,010 A | * | 9/1982 | Baxter | 254/131 |
| 5,971,360 A | * | 10/1999 | Sinsley | 254/131 |
| 6,015,254 A | * | 1/2000 | Keeler | 254/131 |
| 6,056,272 A | * | 5/2000 | Sayler | 254/131 |

* cited by examiner

*Primary Examiner*—Robert C. Watson

(57) ABSTRACT

A lever-action vehicle lift for lifting a from the ground surface. The lift frame defines a vehicle contacting section and a fulcrum section for rotatably supporting the lever frame when the latter is pivoted about the ground surface. A spacing section is solidly attached between the vehicle contacting section and the fulcrum section for maintaining the vehicle contacting section and the fulcrum section in a first predetermined spaced relationship relative to each other. The vehicle contacting section and the fulcrum section are positioned in a common geometrical plane. A lever handle is pivotally attached to the lever frame by a handle pivotal connection so as to allow the lever handle to pivot about a lever pivoting axis extending in the common geometrical plane. The lever frame and the lever handle are configured and sized such that when the lever is in a raising configuration with both a handle ground contacting section and the fulcrum section contacting the ground surface, the common geometrical plane forms an acute angle relative to the ground surface such that the vehicle contacting section is located intermediate and above both the fulcrum section and the handle ground contacting section at a raised distance from the ground surface. The vehicle contacting section is given various configurations for accommodating various motorcycle frame configurations. A handle releasable locking mechanism is also provided for selectively locking the lever handle in a predetermined angular relationship relative to the lever frame.

20 Claims, 3 Drawing Sheets

18
14
71
26
20
50
64
70
21

18
26
30
68
32
74
78
50
20
22
64
80
21

LEVER-ACTION VEHICLE LIFT

FIELD OF THE INVENTION:

The present invention relates to the general field of vehicle accessories and is particularly concerned with a lever-action vehicle lift.

BACKGROUND OF THE INVENTION

Motorcycles, scooters, mopeds and other two-wheeled motorized vehicles are used extensively for both recreational and transportation purposes. Most two-wheeled vehicles collectively referred to as motorcycles, typically include a so called lateral kickstand pivotally attached to a lateral section of the vehicle's frame.

These conventional lateral kickstands typically define a relatively pointed end that is adapted to abuttingly contact the ground surface for temporarily supporting the vehicle in a partially tilted configuration relative to the ground surface. Although quite useful for temporarily supporting the vehicle in a relatively unstable configuration, they are proven to be unacceptable for various other situations.

Some previous generations of motorcycles were provided with a generally centrally located so called central kickstand for supporting the motorcycle in a more stable configuration. However, most modem bicycles are not provided with such a central kickstand and, furthermore, the conventional central kickstand suffered from a set of drawbacks including difficulty in deploying the central kickstand into its operational configuration.

Proper care of two wheeled motorized vehicles through preventive maintenance such as minor tune-ups, minor body work, regular oiling and greasing is performed typically by the owner on a regular basis in order to keep the motorcycle in top running condition. Minor repairs such as replacing tires, chains or the like are also frequently carried out by the owner itself.

In all of the foregoing, it is necessary to have the motorcycle supported in a steady up-right position. The conventional lateral kickstand of most motorcycles are usually unacceptable for such situations since they do not provide a firm support for the motorcycle. Furthermore, such conventional lateral kickstands do not usually adequately raise the wheels off the ground.

Accordingly, in order to allow service of the vehicles various types of ramps or lifts have been developed. However, they suffer from numerous drawbacks including bulkiness and overall mechanical complexity. Furthermore, the vehicles may require emergency servicing at locations wherein such bulky ramps or lifts may not be available.

Two wheeled motorized vehicles are also sometimes stored for relatively long periods such as during the winter period in certain regions. When the motorcycle is stored for relatively long periods of time it is preferable to remove the weight of the frame, motor and other components from the suspension system in order to reduce the risk of damaging the later. The conventional lateral kickstand as again proven to be an unacceptable solution to this type of situation since it only partially releases pressure on the suspension system and tilting of the vehicle uses up valuable storage space.

In an attempt to circumvent the hereinabove mentioned problems the prior art has proposed numerous devices. For example, U.S. Pat. No. 4,113,235 issued Sep. 12, 1978 and naming Wilbert Hartman Jr., as inventor discloses a lever-action jack having a cross-support and a pair of lever assemblies at opposite ends thereof. Although offering a relatively simple solution, the structure disclosed in U.S. Pat. No. 4,113,235 still suffers from a set of drawbacks including potential safety hazards and lack of ergonomic features. Accordingly, there exists a need for an improved lever action vehicle lift.

Advantages of the present invention include the fact that the proposed vehicle lift allows for both lifting and supporting of a two-wheeled motorized vehicle. The proposed vehicle lift allows a single intended user to easily, readily and ergonomically lift a two-wheeled motorized vehicle to a raised position and have the vehicle remain in such a raised position.

The proposed vehicle lift allows the intended user to raise either the front, the rear or both wheels of a two-wheeled motorized vehicle. The vehicle can easily be raised using a set of ergonomical steps that can be performed safely without requiring special tooling, manual dexterity or strength.

The vehicle lift has a built-in feature that allows it to be used ergonomically even in an exiguous environment. This built-in feature also allows for ergonomic use with various vehicle configurations even when the vehicle configuration is modified by saddle bags, bulky pipes or the like.

The proposed vehicle lift also has a built-in feature that allows for selective and reversible blocking of wheel movement so as to improve the over all stability of the vehicle and lift combination. It also allows for customization of the sustentation base depending on the vehicle configuration and available space.

Still further, the proposed device is designed so as to be collapsible in order to minimize storage space when not in use. Over all, the proposed vehicle lift is designed so as to be manufactured using conventional forms of manufacturing, to be of simple construction and easy to use so as to provide a device that will be economically feasible, long lasting and relatively trouble free in operation.

In accordance with an embodiment of the present invention, there is provided a lever-action vehicle lift for lifting a lift contacting section part of a vehicle from an initial distance relative to a ground surface to a raised distance from the ground surface, the vehicle including at least one wheel, the lever comprising a lever frame, the lever frame defining a vehicle contacting means for contacting the lift contacting section; a fulcrum means for rotatably supporting the lever frame when the latter is pivoted about the ground surface between an initial configuration wherein the vehicle contacting means is spaced from the lift contacting section and a raising configuration wherein the vehicle contacting means supports the lift contacting section at the raised distance from the ground surface; a spacing means solidly attached between the vehicle contacting means and the fulcrum means for maintaining the vehicle contacting means and the fulcrum means in a first predetermined spaced relationship relative to each other, the vehicle contacting means and the fulcrum means being positioned in a common geometrical plane; a lever handle having a generally elongated configuration defining a handle first longitudinal end and an opposed handle second longitudinal end, the lever handle also defining a handle ground contacting section; the lever handle being pivotally attached to the lever frame by a handle pivotal connection so as to allow the lever handle to pivot about a lever pivoting axis, the lever pivoting axis extending in the common geometrical plane; the lever frame and the lever handle being configured and sized such that when the lever assembly is in the raising configuration with both the handle ground contacting section and the fulcrum means contacting the ground surface, the common geometrical plane forms an acute angle relative to the ground surface such that the vehicle contacting means is located intermediate and above both the fulcrum means and the handle ground contacting section at the raised distance from the ground surface.

Preferably, the lever-action lift further includes a handle releasable locking means for selectively locking the lever handle in a predetermined angular relationship relative to the lever frame.

Conveniently, the fulcrum means includes a generally elongated fulcrum rod, the fulcrum rod defining a generally rounded ground engaging surface, a fulcrum rod first longitudinal end and a longitudinally opposed fulcrum rod second longitudinal end.

Preferably, the lever pivotal connection includes a handle connecting rod extending substantially perpendicularly from the fulcrum rod in a direction substantially parallel to the common geometrical plane; a handle connecting sleeve rotatably mounted around the handle connecting rod for selective rotation thereabout, the handle connecting sleeve defining a generally cylindrical sleeve wall; the lever handle being attached adjacent the handle first longitudinal end to the handle connecting sleeve for allowing selective pivotal movement around the handle connecting rod.

The lever-action vehicle lift preferably further includes a sleeve releasable locking means for releasably locking the handle connecting sleeve in a predetermined angular relationship relative to the handle connecting rod.

Conveniently, the sleeve releasable locking means includes a sleeve aperture extending through the sleeve wall; a bolt threadably mounted to the sleeve aperture, the bolt defining a bolt tip, the bolt being configured and sized such that the bolt tip frictionally engages an outer surface of the handle connecting rod.

Preferably, the lever handle is spaced laterally from the vehicle contacting means in a direction substantially perpendicular to the spacing provided by the spacing means.

Conveniently, the lever frame further includes a spacing section extending laterally from the vehicle contacting means in a direction substantially parallel to the fulcrum rod, the spacing section defining a lateral spacing rod that extends laterally from the vehicle contacting means in a substantially parallel and spaced relationship relative to the fulcrum rod.

Preferably, the handle connecting rod extend between the lateral spacing rod and a corresponding lateral segment of the fulcrum rod. Also, preferably the handle connecting rod extends from the fulcrum rod adjacent the fulcrum rod second longitudinal end.

Conveniently, the lever handle defines a first handle segment extending from the handle first longitudinal end to the handle ground contacting section and a handle second section extending from the handle ground contacting section to the handle second longitudinal end, the handle second section being configured and sized for abutment with a section of the at least one wheel.

Preferably, the handle second section is angled relative to the handle first segment about the handle contacting section so that when the handle ground contacting section is in contact with the ground surface both the handle first and second sections extend away from the ground contacting section and away from the ground surface. Conveniently, a solidifying plate extends between the handle connecting sleeve and the lever handle.

In one embodiment of the invention, the vehicle contacting means includes a pair of supporting brackets and the spacing means includes a corresponding pair of bracket rods extending between the fulcrum means and the brackets in a direction substantially parallel to the common geometrical plane. Preferably, a stabilizing rod extends between the bracket rods.

In another embodiment of the invention, the vehicle contacting means includes a frame attachment sleeve mounted on an distal extension segment extending laterally from the lateral spacing rod.

In yet another embodiment of the invention, the vehicle contacting means includes a frame supporting platform mounted on an distal extension segment extending laterally from the lateral spacing rod.

In still another embodiment of the invention, the vehicle contacting means further includes an anchoring pin attached to the supporting platform; the anchoring pin defining a pin spacing segment extending away from the supporting platform and a pin anchoring segment extending in a generally parallel and overlying relationship relative to the supporting platform. Preferably, the frame supporting platform is pivotally mounted on the distal extension segment.

In another embodiment of the invention, the vehicle contacting means includes a supporting bracket, the supporting bracket being mounted on at least one and preferably two bracket rods extending from the fulcrum rod in a direction substantially parallel to the common geometrical plane; the supporting bracket having a generally "U"-shaped cross-sectional configuration

BRIEF DESCRIPTION OF THE DRAWINGS

An embodiment of the present invention will now be disclosed, by way of example, in reference to the following drawings in which.

DETAILED DESCRIPTION OF THE DRAWINGS

Figure 3:
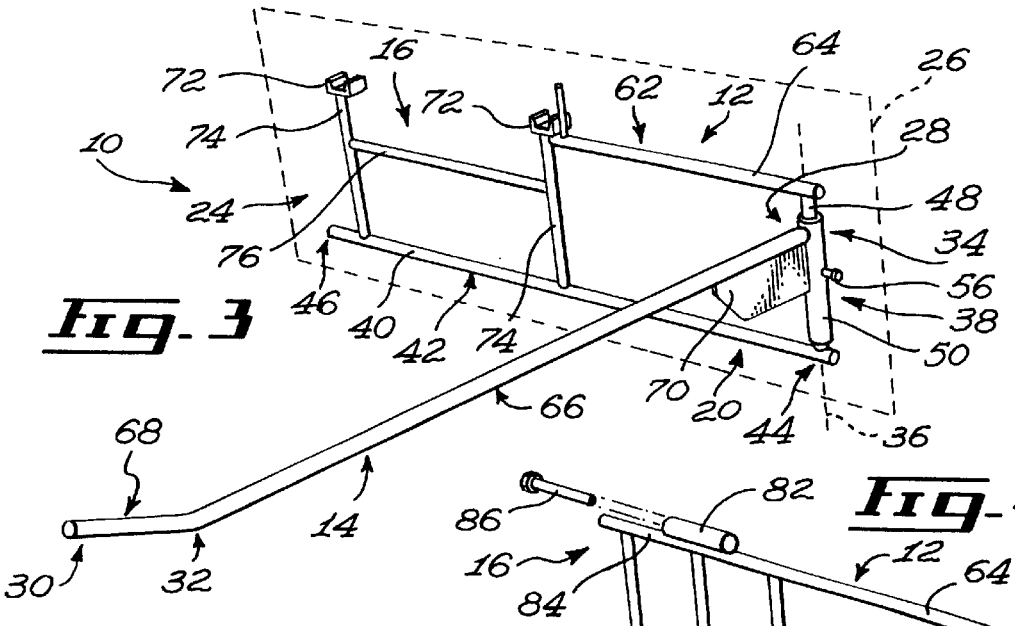
FIG. 3, in a perspective view, illustrates a vehicle lift in accordance with an embodiment of the present invention.

Referring to FIG. 3, there is shown a lever action vehicle lift 10 in accordance with an embodiment of the present invention. The lift 10 includes a lever frame 12 and a lever handle 14.

Figure 1:
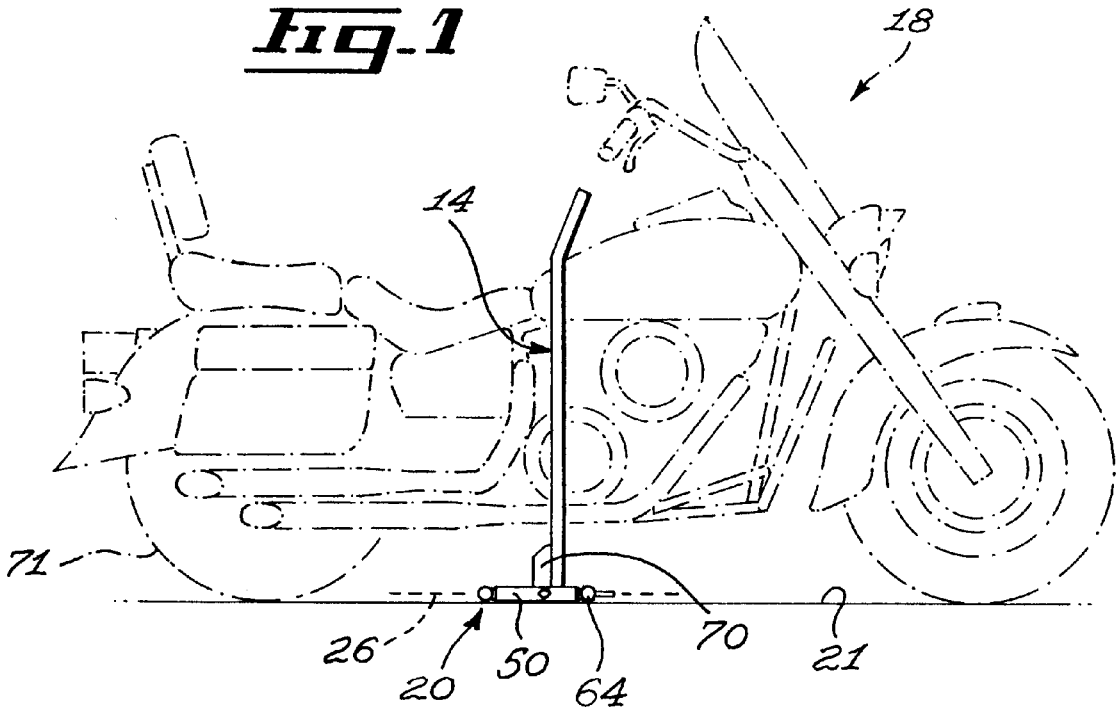
FIG. 1, in an elevational view, illustrates a vehicle lift in accordance with an embodiment of the present invention positioned adjacent a conventional motorcycle, the motorcycle being shown in phantom lines.
Figure 2:
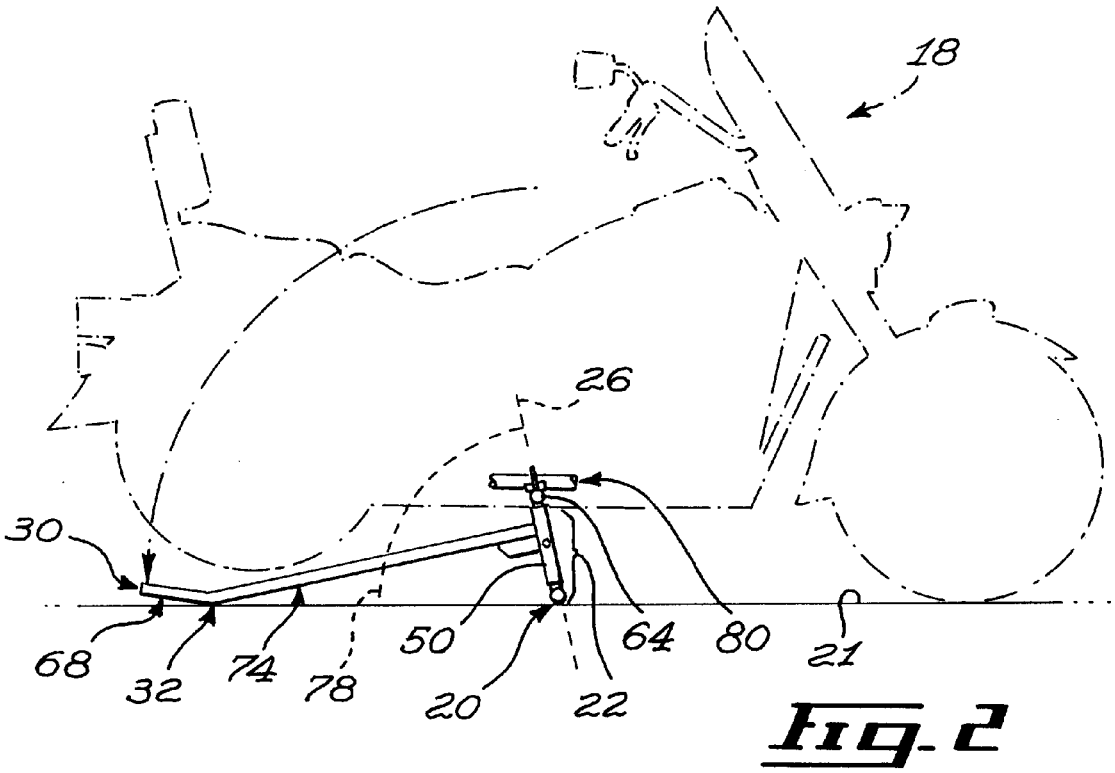
FIG. 2, in an elevational view, illustrates the vehicle lift shown in FIG. 1 in a raising configuration wherein it raises the frame and the rear wheel of the motorcycle shown in FIG. 1.

The lever frame defines a lift contacting means 16 for contacting a lift contacting section 80 part of a vehicle such as the motorcycle 18 shown in FIGS. 1 and 2. The lift contacting section 80 typically includes part of the vehicle frame or any other suitable component solidly attached to the vehicle 18.

The lever frame 12 also includes a fulcrum means 20 for rotatably supporting the lever frame 12 when the latter is pivoted about a ground surface 20 between an initial configuration shown in FIG. 1 wherein the vehicle contacting means 16 is spaced from the lift contacting section of the vehicle 18 and a raising configuration shown in FIG. 2 wherein the vehicle contacting means 16 supports the lift contacting section of the vehicle 18 at a raised distance 22 from the ground surface 20.

The lever frame 12 also includes a spacing means 24 solidly attached between the vehicle contacting means 16 and the fulcrum means 20 for maintaining the vehicle contacting means 16 and the fulcrum means 20 in a first predetermined spaced relationship relative to each other. The vehicle contacting means 16 and the fulcrum means 20 are positioned in a common geometrical plane 26.

The lever handle 14 has a generally elongated configuration defining a handle first longitudinal end 28 and a longitudinally opposed handle second longitudinal end 30. The lever handle 14 also defines a lever ground contacting section 32.

The lever frame 12 and the lever handle 14 are configured and sized such that when the lever is in its raised configuration shown in FIG. 2 with both the lever ground contacting section 32 and the fulcrum means 20 contacting the ground surface 21 the common geometrical plane 26 forms an acute angle 78 relative to the ground surface 21. In such a position, the vehicle contacting means 16 is located intermediate and above the fulcrum means 20 and the ground contacting section 32 at a raised distance 22 from the ground surface 21.

One of the main features of the present invention resides in that the lever handle 14 is pivotally attached to the lever frame 12 by a handle pivotal connection 34. The handle pivotal connection 34 allows the lever handle 14 to pivot about a lever pivoting axis 36. The lever pivoting axis 36 extends in the common geometrical plane 26 defined by the vehicle contacting means 16 and the fulcrum means 20. Preferably, the lever handle 14 also includes a handle releasable locking means 38 for selectively locking the lever handle 14 in a predetermined angular relationship relative to the lever frame 12.

The fulcrum means 20 preferably includes a generally elongated fulcrum rod 40. The fulcrum rod 40 defines a generally rounded ground engaging surface 42. The fulcrum rod 40 also defines a fulcrum rod first longitudinal end 44 and a longitudinally opposed fulcrum rod second longitudinal end 46.

The lever pivotal connection 34 preferably includes a handle connecting rod 48 extending substantially perpendicularly from the fulcrum rod 40 in a direction substantially parallel to the common geometrical plane 26. The lever pivotal connection 34 also preferably includes a handle connecting sleeve 50 rotatably mounted around the handle connecting rod 48 for selective rotation thereabouts. The handle connecting sleeve 50 defines a generally cylindrical sleeve wail 52. The lever handle 14 is attached adjacent the handle first longitudinal end 28 to the handle connecting sleeve 50 thus allowing selective pivotal movement of the lever handle 14 around the handle connecting rod 48.

The handle releasable locking means 38 preferably takes the form of a sleeve releasable locking means for releasably locking the handle connecting sleeve 50 in a predetermined angular relationship relative to the handle connecting rod 48.

Figure 7:
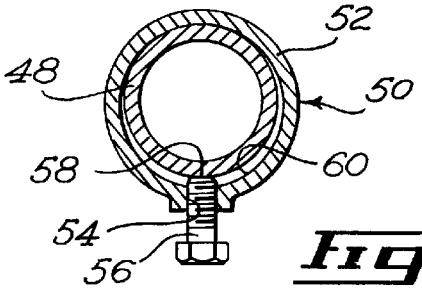
FIG. 7, in a transversal cross sectional view, illustrates a locking mechanism used for locking the lever handle part of the vehicle lift in a predetermined angular relationship relative to the lever frame.

As shown in greater details in FIG. 7, the sleeve releasable locking means includes a sleeve aperture 54 extending through the sleeve wall 52. The sleeve releasable locking means also includes a bolt type component 56 threadably mounted to the sleeve aperture 54. The bolt type component 56 defines a bolt tip 58. The bolt type component 56 is configured and sized so that the bolt tip 58 frictionally engages an outer surface 60 of the handle connecting rod 48.

The lever frame 12 preferably further includes a spacing section 62 extending laterally from the vehicle contacting means 16 in a direction substantially parallel to the fulcrum rod 40. The lever handle 14 is thus preferably laterally spaced from the vehicle contacting means 16 in a direction substantially perpendicular to the spacing provided by the spacing means 16.

The spacing section 62 defines a lateral spacing rod 64 that extends laterally from the vehicle contacting means 16 in a substantially parallel and spaced relationship relative to the fulcrum rod 40. In a preferred embodiment, the handle connecting rod 48 extends from a position adjacent the fulcrum rod first longitudinal end 44 to a corresponding adjacent longitudinal end of the lateral spacing rod 64.

Preferably, the lever handle 14 defines a first handle segment 66 extending from the handle first longitudinal end 28 to the handle ground contacting section 32 and a handle second section 68 extending from the handle ground contacting section 32 to the handle second longitudinal end 30.

Figure 5:
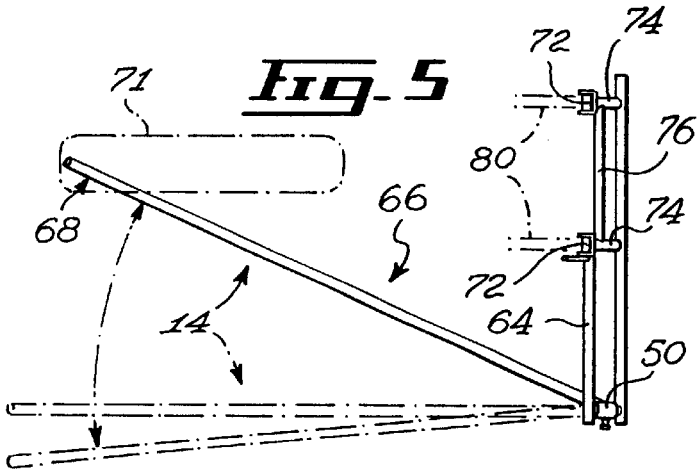
FIG. 5, in a schematic top view with sections taken out, illustrates a vehicle lift in accordance with an embodiment of the present invention with its lever handle being moved to a position adjacent a rear wheel of the vehicle shown in FIG. 1. The rear wheel and the initial position of the lever handle both being shown in phantom lines.

Another main feature of the present invention resides in that the handle second section 68 is preferably configured and sized for abutment with a section of the rear wheel 70 of the vehicle 18 when the lever handle 14 is in the pivoted configuration shown in FIG. 5.

Preferably, the handle second section 68 is angled relative to the handle first section 66 about the handle contacting section 32 so that when the handle ground contacting section 32 is in contact with the ground surface 20 both the handle first and second sections 66, 68 extend away from the ground contacting section 32 in a direction leading away from the ground surface 20 as shown in FIG. 2. This facilitates grasping of the handle second section 68 by allowing insertion of the fingers of the intended user between the ground surface 20 and the handle second section 68 when the lever handle 14 is in the raising position shown in FIG. 2.

The lever handle 14 preferably further includes a solidifying plate 70 extending between the handle connecting sleeve 50 and a corresponding proximal segment of the lever handle 14.

As mentioned previously, the handle pivotal connection 34 represents one of the main features of the present invention. The handle pivotal connection 34 provides several advantages over prior art structures. First, the lever handle 14 can be pivoted to a position shown in full lines in FIG. 5 wherein it is inserted between the rear wheel 71 of the vehicle 18 and the ground surface 20. In this wheel locking position the lever handle 14 acts as a stabilizing means for stabilizing the vehicle 18 in its raised configuration since it reduces the risks of the vehicle 18 moving rearwardly once in its raised configuration. Partial insertion of the lever handle 14 also stabilizes the vehicle lift 10 itself.

Figure 6:
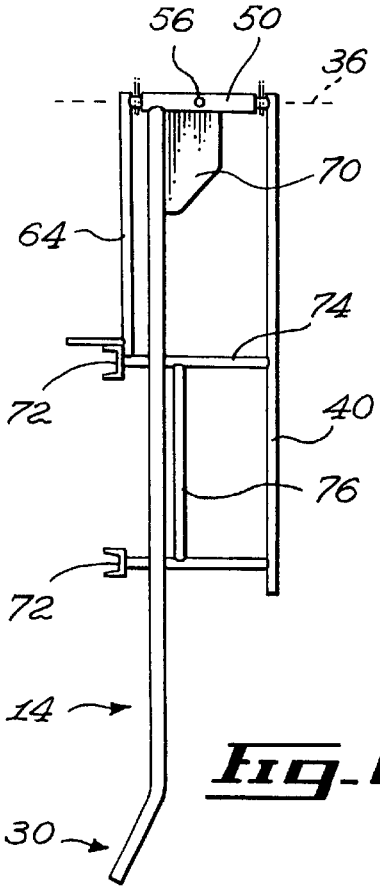
FIG. 6, in a top view, illustrates a vehicle lift in accordance with an embodiment of the present invention in a folded configuration.

Pivotal movement of the lever handle 14 also allows for customization of the sustentation polygonal base formed by the fulcrum rod 40 and the handle ground contacting section 32. Pivotal movement of the lever handle 14 also facilitates ergonomical use of the vehicle lift in exiguous environments and in situations wherein components such as saddle bags, foot pegs and exhaust pipes protrude laterally from the vehicle frame. Still further, pivotal movement of the lever handle 14 allows the latter to be rotated to a folded configuration shown in FIG. 6 wherein it lies in a generally parallel relationship relative to the common geometrical plane 26 so as to reduce overall external dimensions and reduce storage space.

The vehicle contacting means 16 may take various configurations. In a first embodiment of the invention shown in FIG. 3, the vehicle contacting means 16 includes a pair of supporting brackets 72 typically having a generally "U" shaped cross sectional configuration. The spacing means 24 typically includes a corresponding pair of bracket rods 74 extending between the fulcrum rod 40 and the brackets 72 in a direction substantially parallel to the common geometrical plane 26. A stabilizing rod 76 preferably extends between the bracket rods 74. The supporting brackets 72 are adapted to abuttingly contact a pair of corresponding frame components (not shown) part of the motorcycle 18.

Figure 4:
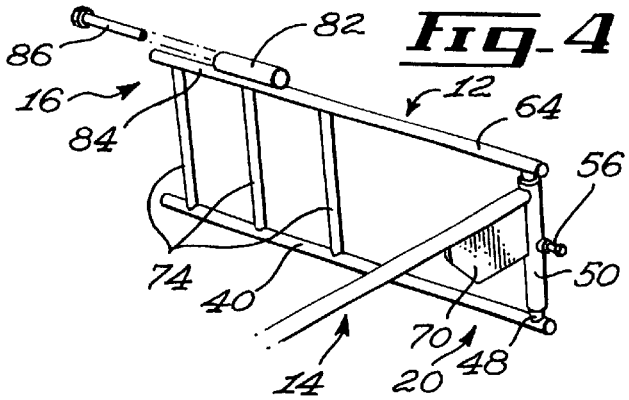
FIG. 4, in a partial perspective view with sections taken out, illustrates a vehicle lift in accordance with another embodiment of the present invention.

In a second embodiment of the invention illustrated in FIG. 4, the vehicle contacting means 16 includes a frame attachment sleeve 82 mounted on an integral distal extension segment 84 of the lateral spacing rod 64. An attachment pin 86 is provided for slidable insertion through the frame attachment sleeve 82 and a pair of frame rings (not shown) extending from the motorcycle frame. Each frame ring is adapted to be positioned adjacent a corresponding longitudinal end of the attachment sleeve 82. The spacing means 24 typically includes at least one and preferably three corresponding bracket rods 74 extending between the fulcrum rod 40 and the distal extension segment 84 in a direction substantially parallel to the common geometrical plane 26.

Figure 8:
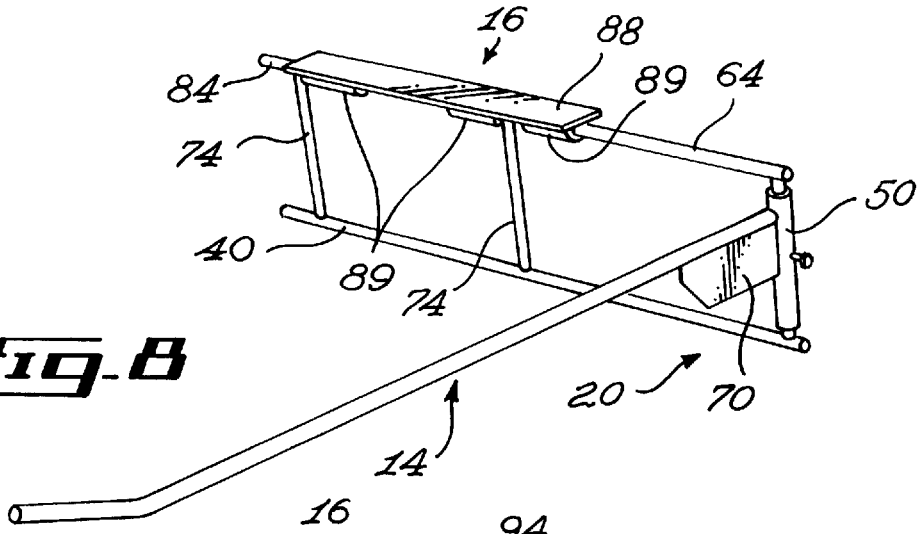
FIG. 8, in a partial perspective view with sections taken out, illustrates part of a vehicle lift in accordance with another embodiment of the present invention.

In a third embodiment of the invention illustrated in FIG. 8, the vehicle contacting means 16 includes a frame supporting platform 88 mounted on an integral distal extension segment 84 of the lateral spacing rod 64. The frame supporting platform 88 is optionally coated with a substantially resilient material such as a layer of elastomeric resin. The frame supporting platform is preferably pivotally mounted on the distal extension segment 84 so as to pivot about the latter using a platform pivotal connecting means. The platform pivotal connecting means preferably includes a pivoting sleeve 89 having a generally "U"-shaped cross-sectional configuration. The distal ends of the legs of the "U"-shaped sleeve 89 are attached to the undersurface of the frame supporting platform 88 while the body of the "U"-shaped sleeve 89 pivotally encircles the distal extension segment 84. This particular embodiment is particularly well suited for motorcycles wherein both the motor and the exhaust pipes do not form a protrusion underneath the frame of the vehicle. The spacing means 24 typically includes at least one and preferably two corresponding bracket rods 74 extending between the fulcrum rod 40 and the distal extension segment 84 in a direction substantially parallel to the common geometrical plane 26.

Figure 9:
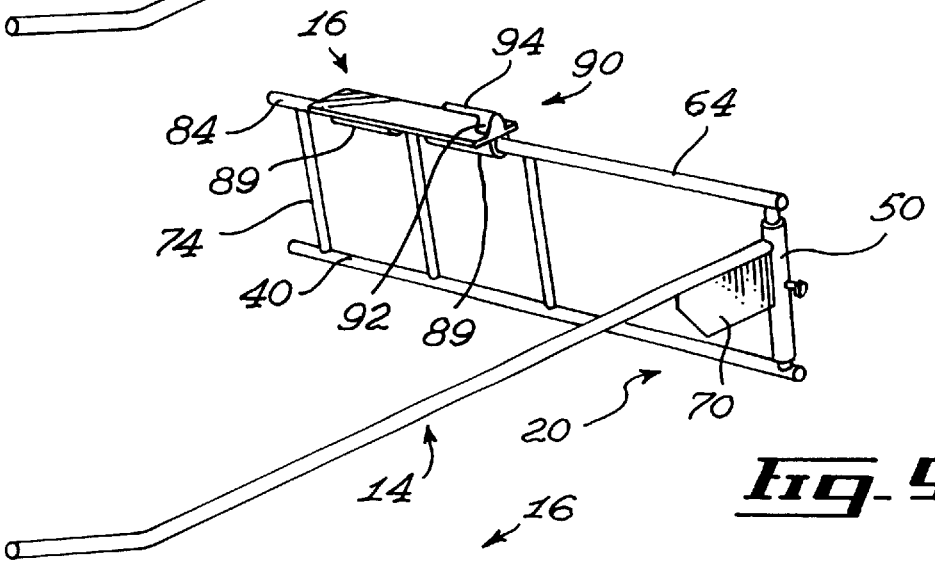
FIG. 9, in a partial perspective view with sections taken out, illustrates part of a vehicle lift in accordance with another embodiment of the present invention.

In a fourth embodiment of the invention illustrated in FIG. 9, the vehicle contacting means 16 includes a frame supporting platform 88 preferably pivotally mounted on an integral distal extension segment 84 of the lateral spacing rod 64 as described for the third embodiment. The vehicle contacting means 16 further includes an anchoring pin 90 attached to the supporting platform 88. The anchoring pin 90 preferably defines a pin spacing segment 92 extending away from the supporting platform 88 and a pin anchoring segment 94 extending in a generally parallel and overlying relationship relative to the supporting platform 88. The spacing means 24 typically includes at least one and preferably three corresponding bracket rods 74 extending between the fulcrum rod 40 and the distal extension segment 84 in a direction substantially parallel to the common geometrical plane 26.

Figure 10:
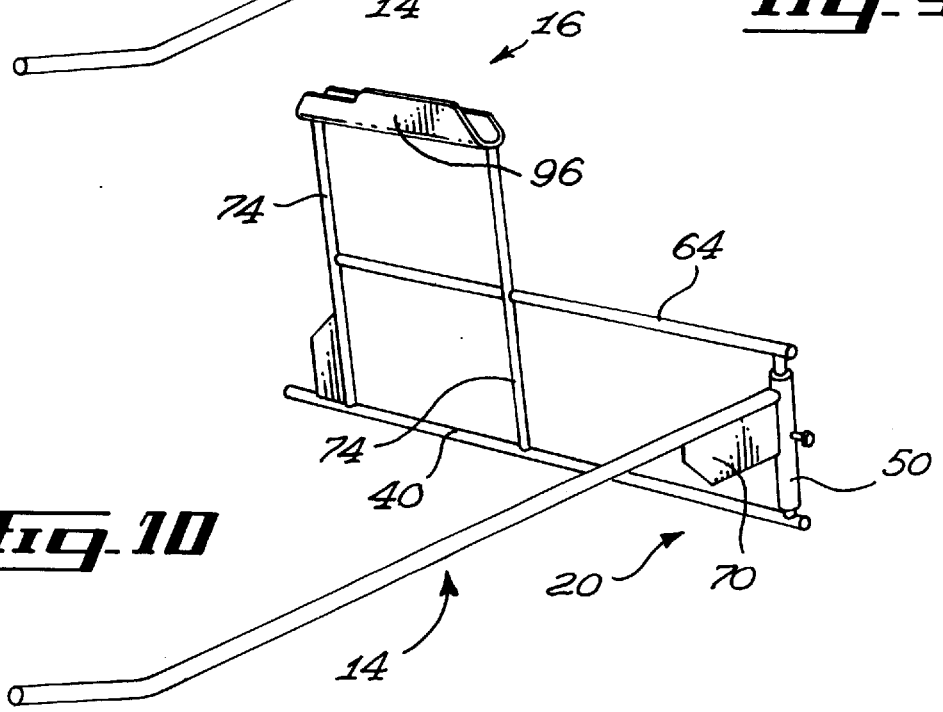
FIG. 10, in a partial perspective view with sections taken out, illustrates part of a vehicle lift in accordance with another embodiment of the present invention.

In a fifth embodiment of the invention illustrated in FIG. 10, the vehicle contacting means 16 includes a supporting bracket 96. The supporting bracket 96 is mounted on at least one and preferably two bracket rods 74 extending from the fulcrum rod 40 in a direction substantially parallel to the common geometrical plane 26. The supporting bracket 96 preferably has a generally "U"-shaped cross-sectional configuration. It should be understood that the vehicle contacting means 16 and the spacing means 24 could take many other configurations to accommodate various vehicle frame configurations without departing from the scope of the present invention.

The embodiments of the invention in which an exclusive privilege or property is claimed are defined as follows:

1. A lever-action vehicle lift for lifting a lift contacting section part of a vehicle from an initial distance relative to a ground surface to a raised distance from said ground surface, said vehicle including at least one wheel, said lever-action lift comprising:

a lever frame, said lever frame defining a vehicle contacting means for contacting said lift contacting section;

a fulcrum means for rotatably supporting said lever frame when the latter is pivoted about said ground surface between an initial configuration wherein said vehicle contacting means is spaced from said lift contacting section and a raising configuration wherein said vehicle contacting means supports said lift contacting section at said raised distance from said ground surface;

a spacing means solidly attached between said vehicle contacting means and said fulcrum means for maintaining said vehicle contacting means and said fulcrum means in a first predetermined spaced relationship relative to each other, said vehicle contacting means and said fulcrum means being positioned in a common geometrical plane;

a lever handle having a generally elongated configuration defining a handle first longitudinal end and an opposed handle second longitudinal end, said lever handle also defining a handle ground contacting section;

said lever handle being pivotally attached to said lever frame by a handle pivotal connection so as to allow said lever handle to pivot about a lever pivoting axis, said lever pivoting axis extending in said common geometrical plane;

said lever frame and said lever handle being configured and sized such that when said lever frame is in said raising configuration with both said handle ground contacting section and said fulcrum means contacting said ground surface, said common geometrical plane forms an acute angle relative to said ground surface such that said vehicle contacting means is located intermediate and above both said fulcrum means and said handle ground contacting section at said raised distance from said ground surface.

2. A lever-action vehicle lift as recited in claim 1 further including a handle releasable locking means for selectively locking said lever handle in a predetermined angular relationship relative to said lever frame.

3. A lever-action vehicle lift as recited in claim 1 wherein said fulcrum means includes a generally elongated fulcrum rod, said fulcrum rod defining a generally rounded ground engaging surface, a fulcrum rod first longitudinal end and a longitudinally opposed fulcrum rod second longitudinal end.

4. A lever-action vehicle lift as recited in claim 3 wherein said lever pivotal connection includes a handle connecting rod extending substantially perpendicularly from said fulcrum rod in a direction substantially parallel to said common geometrical plane;

a handle connecting sleeve rotatably mounted around said handle connecting rod for selective rotation thereabout, said handle connecting sleeve defining a generally cylindrical sleeve wall;

said lever handle being attached adjacent said handle first longitudinal end to said handle connecting sleeve for allowing selective pivotal movement around said handle connecting rod.

5. A lever-action vehicle lift as recited in claim 4 further including a sleeve releasable locking means for releasably locking said handle connecting sleeve in a predetermined angular relationship relative to said handle connecting rod.

6. A lever-action vehicle lift as recited in claim 5 wherein said sleeve releasable locking means includes a sleeve aperture extending through said sleeve wall;

a bolt threadably mounted to said sleeve aperture, said bolt defining a bolt tip, said bolt being configured and sized such that said bolt tip frictionally engages an outer surface of said handle connecting rod.

7. A lever-action vehicle lift as recited in claim 1 wherein said lever handle is spaced laterally from said vehicle contacting means in a direction substantially perpendicular to the spacing provided by said spacing means.

8. A lever-action vehicle lift as recited in claim 4 wherein said lever frame further includes a spacing section extending laterally from said vehicle contacting means in a direction substantially parallel to said fulcrum rod, said spacing section defining a lateral spacing rod that extends laterally from said vehicle contacting means in a substantially parallel and spaced relationship relative to said fulcrum rod.

9. A lever-action vehicle lift as recited in claim 8 wherein said handle connecting rod extend between said lateral spacing rod and a corresponding lateral segment of said fulcrum rod.

10. A lever-action vehicle lift as recited in claim 9 wherein said handle connecting rod extends from said fulcrum rod adjacent said fulcrum rod second longitudinal end.

11. A lever-action vehicle lift as recited in claim 1 wherein said lever handle defines a first handle segment extending from said handle first longitudinal end to said handle ground contacting section and a handle second section extending from said handle ground contacting section to said handle second longitudinal end, said handle second section being configured and sized for abutment with a section of said at least one wheel.

12. A lever-action vehicle lift as recited in claim 11 wherein said handle second section is angled relative to said handle first segment about said handle contacting section so that when said handle ground contacting section is in contact with said ground surface both said handle first and second sections extend away from said ground contacting section and away from said ground surface.

13. A lever-action vehicle lift as recited in claim 4 further including a solidifying plate extending between said handle connecting sleeve and said lever handle.

14. A lever-action vehicle lift as recited in claim 1 wherein said vehicle contacting means includes a pair of supporting brackets and said spacing means includes a corresponding pair of bracket rods extending between said fulcrum means and said brackets in a direction substantially parallel to said common geometrical plane.

15. A lever-action vehicle lift as recited in claim 13 further including a stabilizing rod extending between said bracket rods.

16. A lever-action vehicle lift as recited in claim 1 wherein said vehicle contacting means includes a frame attachment sleeve mounted on an distal extension segment extending laterally from said lateral spacing rod.

17. A lever-action vehicle lift as recited in claim 1 wherein said vehicle contacting means includes a frame supporting platform mounted on an distal extension segment extending laterally from said lateral spacing rod.

18. A lever-action vehicle lift as recited in claim 17 wherein said vehicle contacting means further includes an anchoring pin attached to said supporting platform; said anchoring pin defining a pin spacing segment extending away from said supporting platform and a pin anchoring segment extending in a generally parallel and overlying relationship relative to said supporting platform.

19. A lever-action vehicle lift as recited in claim 17 wherein said frame supporting platform is pivotally mounted on said distal extension segment.

20. A lever-action vehicle lift as recited in claim 1 wherein said vehicle contacting means includes a supporting bracket, said supporting bracket being mounted on at least one and preferably two bracket rods extending from said fulcrum rod in a direction substantially parallel to said common geometrical plane; said supporting bracket having a generally "U"-shaped cross-sectional configuration.

* * * * *